United States Patent [19]

von Schuckmann

[11] Patent Number: 4,846,372

[45] Date of Patent: Jul. 11, 1989

[54] DISPENSER FOR PASTE COMPOSITIONS

[75] Inventor: Alfred von Schuckmann, Kevelaer, Fed. Rep. of Germany

[73] Assignee: Mega Plast product- u. Verpackungsentwicklung Marketing Gesellschaft mit beschränkter Haftung & Co., Nuremberg, Fed. Rep. of Germany

[21] Appl. No.: 125,427

[22] Filed: Nov. 25, 1987

[30] Foreign Application Priority Data

Oct. 14, 1987 [DE] Fed. Rep. of Germany ..... 3734812

[51] Int. Cl.[4] ..... B67D 5/52; B65D 37/00

[52] U.S. Cl. ..... 222/136; 222/145; 222/209; 222/383; 222/492; 137/508; 137/516.11

[58] Field of Search ..... 222/94, 136, 145, 209, 222/212, 129, 321, 383, 414, 492, 522, 391; 137/508, 516.11, 516.13

[56] References Cited

U.S. PATENT DOCUMENTS

| | | | |
|---|---|---|---|
| 1,346,897 | 7/1920 | King | 222/492 |
| 1,969,395 | 8/1934 | Chicoine | 222/492 |
| 2,789,731 | 4/1957 | Marraffino | 222/129 |
| 3,305,127 | 2/1967 | Baranne | 222/522 X |
| 3,474,934 | 10/1969 | Forim | 222/136 |
| 3,592,361 | 7/1971 | Marand | 222/136 |
| 4,457,454 | 7/1984 | Meshberg | 222/212 X |
| 4,585,149 | 4/1986 | Zulauf | 222/94 |
| 4,696,415 | 9/1987 | Meshberg | 222/212 X |
| 4,708,267 | 11/1987 | Sieverding et al. | 222/212 X |
| 4,775,080 | 10/1988 | Mettenbrink | 222/391 |

FOREIGN PATENT DOCUMENTS

| | | | |
|---|---|---|---|
| 0054212 | 11/1981 | European Pat. Off. . | |
| 0221362 | 5/1987 | European Pat. Off. | 222/383 |
| 2611644 | 9/1977 | Fed. Rep. of Germany . | |
| 3408762 | 9/1985 | Fed. Rep. of Germany . | |
| 3509178 | 9/1986 | Fed. Rep. of Germany . | |

*Primary Examiner*—Joseph J. Rolla
*Assistant Examiner*—Gregory L. Huson
*Attorney, Agent, or Firm*—Martin A. Farber

[57] ABSTRACT

A multi-component toothpaste pump dispenser utilizes a delivery tube extending below the reservoir of striping paste and into the reservoir of main paste. The delivery tube has holes at the juncture of the top of the tube and the top wall of the pump chamber to allow passage of the striping component while the main component flows axially through the tube. A valve closes all of the openings when the pump chamber reforms to incrementally advance a piston type follower.

9 Claims, 3 Drawing Sheets

DISPENSER FOR PASTE COMPOSITIONS

FIELD AND BACKGROUND OF THE INVENTION

The present invention relates to a dispenser for paste compositions having a delivery tube and a resiliently reformable pump element, the delivery tube being adapted to be closed by a valve body and in this way, upon a reforming of the pump element, a piston can be moved in the emptying direction; furthermore, to accommodate a passage of one component of the composition, a shaft (14) of the valve body (12) is developed as a hollow body, and to accomodate the passage of a second component of the composition, lateral passage openings (18) which can be closed by the valve body (12) are formed.

Various embodiments of such dispensers are known. In this connection reference may be had, by way of example, to German Pat. No. 2,611,644. With that known dispenser, however, it is not possible to dispense paste compositions which contain different components, for instance the formation of a stripe by a second component on a main strand of paste composition of a first component. In this connection, there is furthermore known European Pat. No. B1 54 212 with which it is possible to deliver paste composition of a second component for the formation of stripes on the main strand consisting of the first component. For this purpose, said patent proposes arranging alongside the delivery tube for the main strand a second delivery tube which communicates, in the region of emergence of the first delivery tube, with the latter via connecting openings. Furthermore, there is assured as known in said patent a dispenser at the delivery end of which there is present an insert which has an outlet tube extending coaxially to the longitudinal axis of the container as well as an annular space which surrounds said outlet tube and which is connected to the outlet tube via connecting holes. In these last two dispensers the moving up of the piston is, however, effected by a rod which is connected to the actuating handle, the piston sliding up on said rod upon actuation.

SUMMARY OF THE INVENTION

In contradistinction to this, the object of the present invention is to develop a dispenser of the aforementioned type for the possible dispensing of paste compositions formed of several components. This object is achieved in a dispenser having the features set forth in the ensuing description.

Due to the fact that, in accordance with the invention, the shaft of the valve body is developed as a hollow body for the passage of one component of the composition. The valve body itself is used not only to close off the delivery tube on the return movement of the piston but also, at the same time, serves as guide element for the composition. The passage openings which are adapted to be closed by the valve body prevent the composition of the second component from being drawn back (in part) upon the return movement of the piston, and the composition of the first component from entering in this connection also into the space of the composition of the second component. The passage openings for the first component can be developed below the closure region of the valve body as seen in the direction of flow. It has been found that even the arrangement of the passage opening in the region of closure of the valve body does not lead to the development of stripes or the like of unsatisfactory appearance.

In the preferred embodiment of the invention the valve body is spring-loaded. It can rest by means, for instance, of spring legs formed on the valve body against a region of the delivery tube which extends above the valve body. As an alternative to this, the spring legs can also rest within the pump element, which extends, for instance, substantially below the valve body. By means of the spring-loading, the pressure load upon the delivery movement of the pump can for instance be adjusted. In principle, operation of the dispenser of the invention is, however, possible also without the spring load, solely on the basis of the movement of the valve body within the composition upon the pumping movement.

The invention furthermore proposes that the delivery tube have a constricted section for the mounting of the valve body and that the passage openings be developed in the constricted region. In this way, the stream of composition of the second component is given sufficient space to add onto the stream of composition of the first component. In addition, an approximately funnel-shaped constriction of the delivery tube which opens upwardly to face in the dispenser emptying direction in the constricted region and a development of the valve body adapted to this, and in obtaining a good seal in closed condition. It is also provided that the delivery tube have a guide region for the shaft of the valve body, for instance by development of a tubular stump within which the shaft is slidably received.

The shaft, which in accordance with the invention is in the form of a hollow body, is preferably formed on a substantially plate-shaped closure region of the valve body in the region of the constricted sections via arms. The closure region of the valve body serves, so to speak, as baffle plate for the stream of composition of the first component rising through the shaft. The stream of composition of the first component is deflected laterally at the closure region and emerges from the shaft through the openings created by the arms. When the valve body is open the stream of composition of the first component flows, with the addition of the stream of composition of the second component, around the closure region of the valve body.

It is furthermore preferred that the delivery tube be developed in a headpiece which is movable together with the pump element. The delivery tube is in this case moved substantially by the same amount as the pump element when the headpiece is compressed.

BRIEF DESCRIPTION OF THE DRAWINGS

The invention is described below in detail, with reference to the enclosed drawings which, however, shows merely one embodiment, and in which.

DETAILED DESCRIPTION OF THE PREFERRED EMBODIMENT

Figure 1:
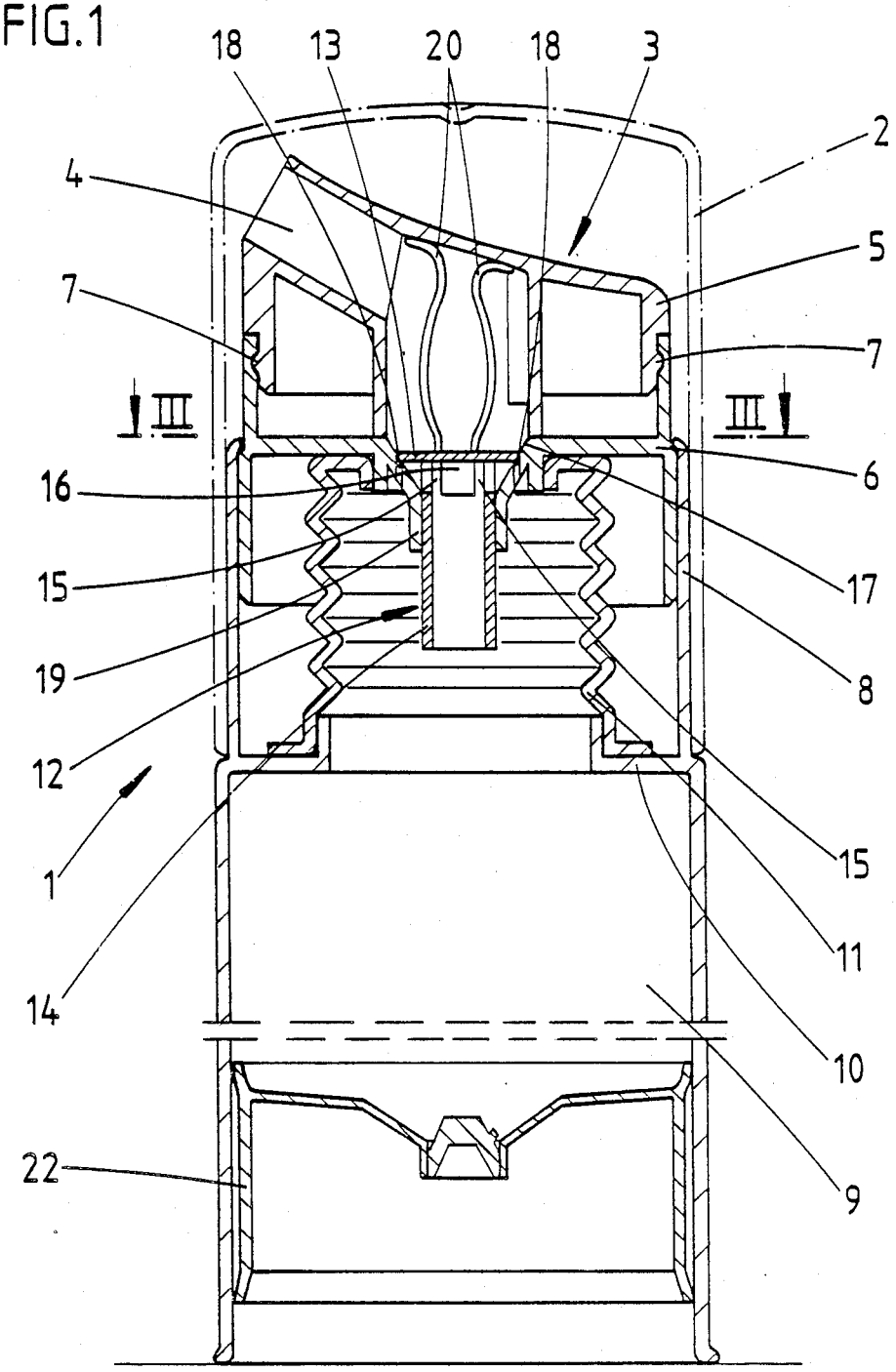
FIG. 1 is a longitudinal sectional view through a dispenser according to the invention, in which spring elements of the valve body rest against the delivery tube.

There is shown and described a dispenser designated generally by the reference numeral 1 (FIGS. 1 and 2), the dispenser being adapted to be closed by a cap 2 which has been merely indicated. The dispenser 1 furthermore has a headpiece 3 which has a delivery tube 4. A handle 5 is formed integrally on the delivery tube 4. The element which has the delivery tube 4 and the handle 5 is mounted, for instance snapped, into a structural part 6. The beads 7 provide a form-locked mounting.

The structural part 6 can slide within a guide form 8. Within the structural part 6, and upon a mounting bottom 10 developed on the guide form 8 there is mounted an elastically deformable bellows 11. Beneath the mounting bottom 10 and enclosed within the guide form 8 is a cylindrical storage space 9 for paste composition.

With respect to the bellows 11, reference is had, by way of example, to Federal Republic of Germany OS 35 09 178. The bellows described therein can also be used in the dispenser described here.

Within the delivery tube 4 there is mounted a valve body 12 which has a closure region 13, and a shaft 14 developed as a hollow body disposed formed on the closure region 13.

The shaft 14 is connected via arms 15 to the closure region 13. Composition passing through the shaft 14 can emerge through openings 16 between the arms 15 and then flow around the closure region 13.

Figure 3:
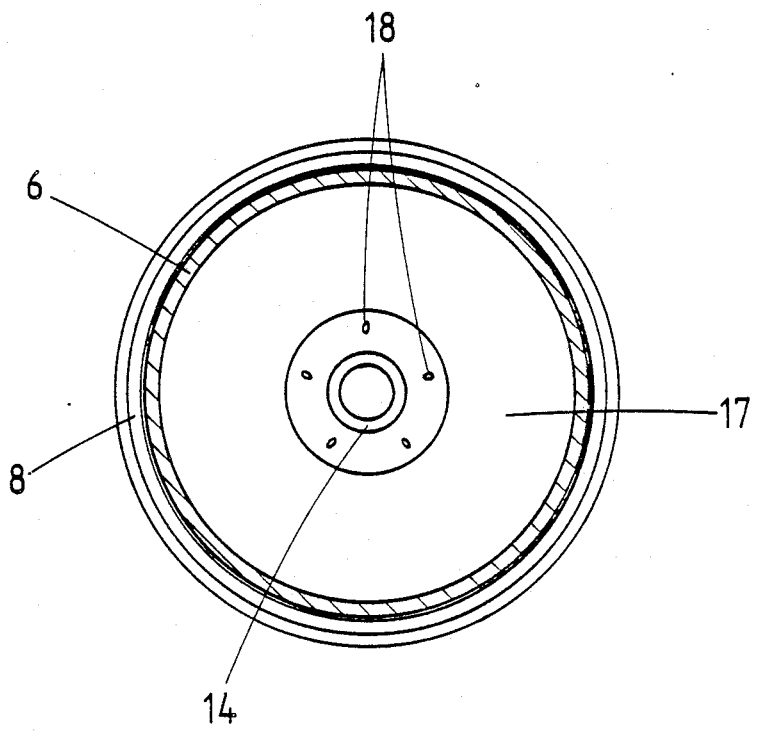
FIG. 3 is a partial section through the object of FIG. 1 along the line III—III, with the valve body removed.

The valve body 12 is mounted in a constricted region 17 of the delivery tube 4 or, more precisely in the case of the embodiment, of the structural part 6 shown by way of example. Within the constricted region 17 there are developed passage openings 18 (see also FIG. 3) for the passage of a second component of paste composition which can be present in the annular chamber between the shaft 14 and the bellows 11, while the first component of the paste composition is contained in the downwardly adjacent space of the dispenser.

Below the constricted region 17 there is furthermore developed a guide region 19 in the form of a tubular stump for the guiding of the valve body 12 in the case of the embodiment shown by way of example, namely for the guiding of the shaft 14.

Upon actuation by the exerting of pressure on the handle 5, the handle 5, together with the structural part 6 firmly connected to it, is moved downward, as a result of which the bellows 11 is compressed. Paste composition of a first component which is present in the lower region of the dispenser pushes its way through the shaft 14 of the valve body 12 and emerges laterally from the shaft 14 through the opening 16 below the closure region 13. At the same time, paste composition of the second component, for instance of a second color, is expressed through the openings 18 in the constricted region 17 and adds onto the main stream flowing upward to the delivery tube 4.

The composition which flows through the shaft 14 and is deflected by the closure region 13 lifts the valve body 12 from its valve-seat surface in the constricted region 17. Excessive lifting can be prevented by the spring legs 20 or 21. While the spring legs 20 (FIG. 1) support the valve body 12 at the top against the delivery tube 4, the spring legs 21 (FIG. 2) support the valve body within the pump element. As an alternative to this, merely stop members can also be provided.

Figure 2:
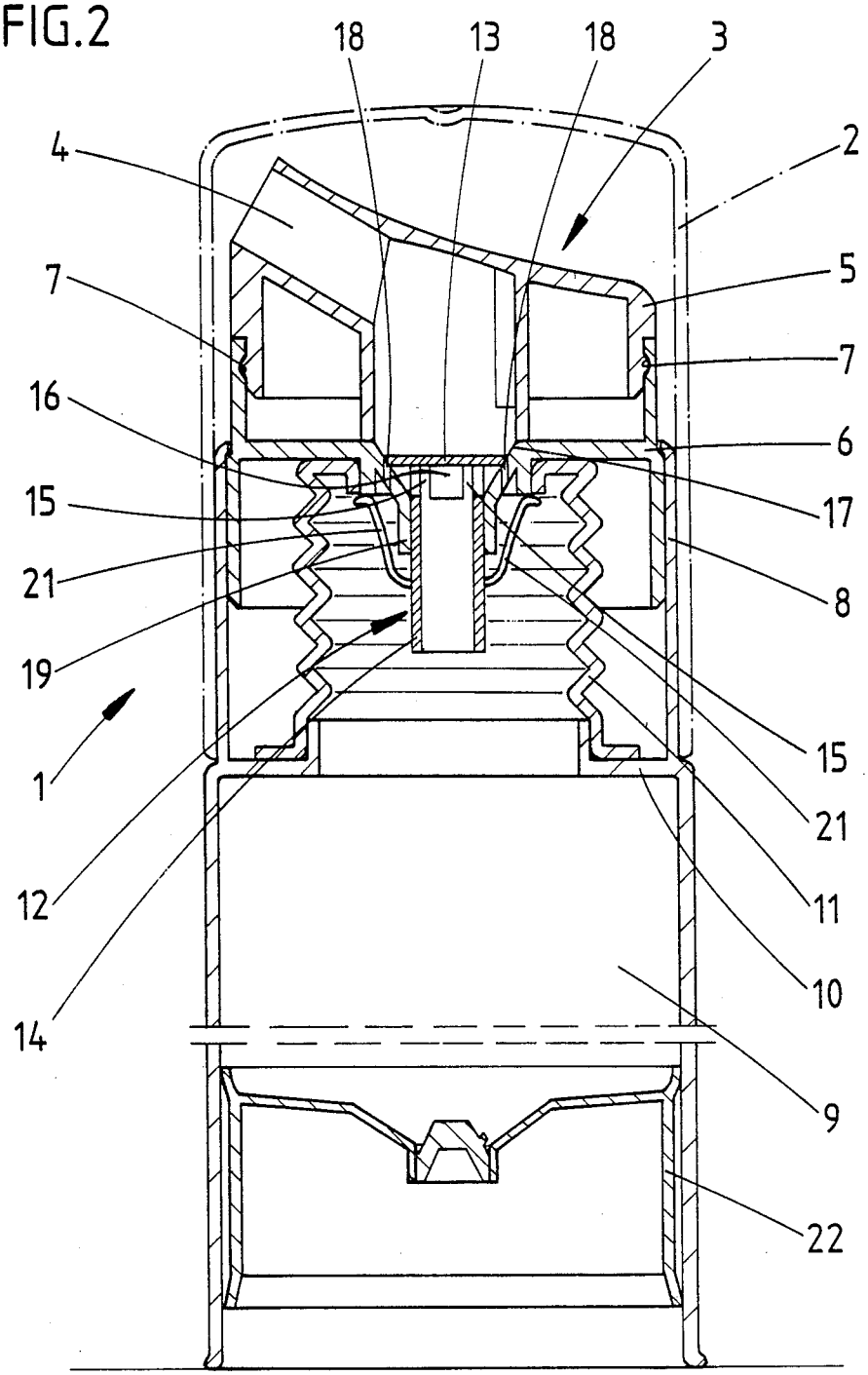
FIG. 2 is a view similar to FIG. 1, in which the spring elements rest within the pump element.

After the release of the handle 5, the bellows 11 forms itself plastically back into the shape shown, for instance, in FIG. 1, as a result of which, due to the inertia of the composition, the valve body 12 is also brought immediately into sealing application within the constricted region 17. This is aided by the spring legs 20 or 21. After a sealing seating of the valve body 12 within the constricted region 17, the piston 22, which is movable in known manner only in the emptying direction, is pulled back by further recovery of the bellows 11.

The features of the invention disclosed in the above specification, drawing and claims can be of importance for the invention and its different embodiments both individually and in any desired combination.

I claim:

1. A dispenser for paste composition comprising:

a delivery tube extending into a storage chamber of the dispenser containing a first composition, a resiliently reformable pump element, a movable valve body with a guide shaft, the guide shaft extending in the delivery tube, a piston below the shaft with the storage chamber above the piston, and a set of passage openings in the delivery tube adapted for directing therethrough a second composition for forming stripes on the first composition in the delivery tube; and wherein the delivery tube has a constricted region forming a seat for the valve body, the passage openings for the second composition being located in the constricted region, the valve body when on the constricted region closing off simultaneously the delivery tube with the first composition and the passage openings with the second composition; and the valve body being movable away from the constricted region whereby passage of the first composition through the delivery tube takes place and passage of the second composition takes place via the passage openings; and the piston being moveable in a dispenser emptying direction upon reforming of the pump element with the valve body moving onto the constricted region.

2. A dispenser according to claim 1, wherein the valve body is spring-loaded in a closing direction.

3. A dispenser according to claim 1, wherein the valve body comprises a substantially plate-shaped closure portion adjacent the constricted region; and wherein the shaft is supported on the plate-shaped closure portion via arms which are spaced from each other.

4. A dispenser according to claim 1, wherein the delivery tube is formed in a headpiece which is movable together with the pump element relative to a guide form of the dispenser.

5. A dispenser according to claim 1, wherein said pump element is a bellows.

6. A dispenser according to claim 1, wherein the delivery tube has a guide region for guiding the guide shaft extending therein.

7. A dispenser according to claim 6, wherein said guide region is vertically disposed whereby said valve body via said guide shaft is vertically movable.

8. A dispenser according to claim 1, wherein said delivery tube is slidably mounted on a dispenser container forming the storage chamber, and said pump element is disposed on said container and operatively biases said delivery tube.

9. A dispenser according to claim 8, wherein said constricted region faces upwardly in the dispenser emptying direction.

* * * * *